US006386301B1

(12) United States Patent
Rear

(10) Patent No.: US 6,386,301 B1
(45) Date of Patent: May 14, 2002

(54) DOWN-HOLE HAMMER

(76) Inventor: Ian Graeme Rear, 24 Hanwell Way, Bassendean, Western Australia (AU), 6054

( * ) Notice: Subject to any disclaimer, the term of this patent is extended or adjusted under 35 U.S.C. 154(b) by 0 days.

(21) Appl. No.: 09/509,589

(22) PCT Filed: Oct. 1, 1998

(86) PCT No.: PCT/AU98/00828

§ 371 Date: Jun. 20, 2000

§ 102(e) Date: Jun. 20, 2000

(87) PCT Pub. No.: WO99/18324

PCT Pub. Date: Apr. 15, 1999

(30) Foreign Application Priority Data

Oct. 1, 1997 (AU) ..... PO9570

(51) Int. Cl.[7] ..... E21B 4/14
(52) U.S. Cl. ..... 175/296; 175/321; 299/69
(58) Field of Search ..... 175/296, 293, 175/297, 321; 299/69

(56) References Cited

U.S. PATENT DOCUMENTS

| | | | | |
|---|---|---|---|---|
| 4,084,646 A | | 4/1978 | Kurt | |
| 4,790,390 A | | 12/1988 | Sweeny | 173/17 |
| 4,819,746 A | | 4/1989 | Brown et al. | 175/296 |
| 5,497,839 A | * | 3/1996 | Moir | 175/65 |

FOREIGN PATENT DOCUMENTS

| | | | | |
|---|---|---|---|---|
| AU | 56523/86 A | | 10/1986 | |
| AU | 40793/96 A | | 7/1996 | |
| AU | 28347/97 A | | 1/1998 | |
| EP | 0 040 026 A1 | * | 11/1981 | |
| WO | WO-92/01138 A1 | * | 1/1992 | |
| WO | WO-93/08364 A1 | * | 4/1993 | |
| WO | WO-94/23171 A1 | * | 10/1994 | |

* cited by examiner

*Primary Examiner*—David Bagnell
*Assistant Examiner*—Jennifer R. Dougherty
(74) *Attorney, Agent, or Firm*—Ladas & Parry

(57) ABSTRACT

A down hole hammer comprising a cylindrical casing defining a piston chamber between a top sub at one end and a drill bit support at the other end, a piston within the piston chamber for reciprocation between the one and other end, the piston having a central portion which is sealingly engaged with the internal wall of the casing, one end portion of the piston being intended to impact on the drill bit with movement to an impact position at which position the one end portion sealingly defines a first space at the one end of the piston chamber, the internal wall of the casing adjacent the top sub having two sets of axially spaced fluid ports, the piston adapted to cooperate with a first set of the fluid ports to admit fluid into the first space when the piston is in the impact position and cause movement of the piston to a raised position where the piston is in spaced relation from the drill bit support, the piston adapted to cooperate with a second set of said set of fluid ports to admit fluid into a second space at the other end of the piston chamber when the piston is adjacent the top sub to cause movement of the piston to the impact position, wherein the admission of fluid to the second space is at least reduced as the piston moves to a fully raised position.

18 Claims, 13 Drawing Sheets

DOWN-HOLE HAMMER

The present invention relates to a down hole hammer.

BACKGROUND OF THE INVENTION

Down hole hammers usually utilise compressed air to effect reciprocation of the hammer in order to effect their hammering action. In order to improve the performance of hammers it has been a characteristic of such hammers that the air which has been delivered to the hammers has increased in pressure significantly over the years. However, the hammers according to previous designs have not significantly changed in design to accommodate for the increased pressure and as a result the hammers have failed with this increased pressure due to the resultant increased stresses that are created within the hammer. In addition previous hammers have not fully utilised the energy contained in the pressurised fluid delivered to them.

The prior art to the invention is exemplified by U.S. Pat. Nos. 4,084,646, 4,790,390, 4,819,746 and AU-B-40793/96. The difficulty with the high fluid pressures which are currently being applied to hammers relates to the manner in which the pressurised fluid is to be introduced into the hammer to achieve the greatest effect but with the minimum of fluid. It is conventional practice as disclosed in each of the above specifications to deliver fluid into the hammer to effect movement of the piston to the impact position when the piston is at its fully raised position. As a result the fresh injection of pressurised fluid id effected when the piston is decelerating, changing direction and accelerating. This does not comprise an efficient use of the energy available from the pressurised fluid and results in the relevant ports being open for a greater period of time than is necessary. In addition it is important that the lubricant which is entrained in the pressurised fluid is delivered directly to the surfaces of the hammer which are in sliding engagement and this has not been found to be the case in at least some of the prior art. In addition many of the prior art hammers have provided the valving required for operation of the hammer by providing ports through the body of the hammer and/or providing counterbores in the ends of the central bore of the piston. It has been found that this feature can result in structural weaknesses in the piston and reduces the mass of the piston which reduces the drilling capacity of the hammer.

It is an object of this invention to provide a down hole hammer which at least partially overcomes some of the difficulties of the previous hammers.

DISCLOSURE OF THE INVENTION

Accordingly the invention resides in a down hole hammer comprising a cylindrical casing having a top sub at one end which is adapted to be mounted to a drill string and a drill bit support at the other end to define a piston chamber, said drill bit support being adapted to receive a drill bit, a piston received within the piston chamber for reciprocation between the one end and the other end, said piston being formed with a central portion which is slidingly and sealingly engaged with the internal wall of the casing, said central portion providing a first shoulder at the end proximate the top sub, said piston having one end portion which is intended to impact on the drill bit on movement of the piston to the impact position and the one end portion being configured to be sealingly engaged with the drill bit support and/or the internal face of the piston chamber when the piston is in the impact position to define a first space between the internal wall of the piston chamber, the one end portion and the drill bit support, a portion of the length of the internal wall of the casing adjacent the top sub being provided with two sets of fluid delivery ports at locations spaced axially along the portion of the length of the casing, the external radial face of the piston and or the radial face of the piston chamber being formed to enable the piston to cooperate with the internal wall of the casing and with a first set of said fluid ports to admit fluid into the first space when the piston is in the impact position to cause movement of the piston to a raised position at which position the piston is in spaced relation from the drill bit support, the external radial face of the piston and or the radial face of the piston chamber being formed to enable the piston to cooperate with the internal wall of the casing and with the second set of said set of ports to admit fluid into a second space between the piston and the top sub when the piston is adjacent the top sub to cause movement of the piston to the impact position, wherein the admission of fluid to the second space is at least reduced as the piston moves to the fully raised position.

According to a preferred feature of the invention the drill bit support further comprises, in part, an annular bush supported in the casing to extend into the piston chamber from the drill bit support, the one end portion of said piston having a reduced diameter to provide a second shoulder at the proximate end of the central portion, the area of the second shoulder being greater than the area of the first shoulder, the one end portion being configured to be sealingly engaged with the annular bush when the piston is in the impact position to define the first space.

According to a preferred feature of the invention the portion of the length of the internal wall of the casing is defined by an inner sleeve extending from the top sub in the direction of the drill bit support and providing a plenum space between the sleeve and the casing which is in communication with fluid being delivered from the top sub, said sets of fluid ports being provided in the sleeve. According to a preferred feature of the previous feature the inner sleeve provides a portion of the internal face of the piston chamber which is of reduced diameter.

According to a preferred feature of the invention the other end portion of the piston is of a reduced diameter and is formed with at least two annular ribs at axially spaced locations along the other end portion which are slidably and sealingly engaged with the inner sleeve wherein a third space is defined between the radial face of the piston chamber, the radial face of the piston, the innermost rib and the first shoulder. According to a preferred feature of the invention the third space is able to open into the first space when the piston is at or in the vicinity of the impact position. According to a preferred form of this feature of the invention the external radial face of the piston and the internal radial face of the piston chamber are formed to provide cooperating formations which control the flow of fluid between the third and first space with relative movement between the piston and the piston chamber. According to one embodiment the innermost rib is located to cooperate with the first set of ports to control the delivery of fluid to the third space wherein fluid flow to the third space is closed as the piston approaches the raised position. According to an alternative embodiment the first set of ports are in constant communication with the third space. According to a preferred feature of the previous preferred form the cooperating formations in the surface of the piston and the piston chamber comprise a plurality of flute-like recesses formed on the surface of the central portion which extend from the first shoulder to an intermediate location on the central portion and one or more recesses formed in the internal face of the casing. According to an embodiment of the previous preferred feature the axes of the flute-like recesses are angularly offset from the longitudinal axis of the piston to substantially the same extent and in substantially the same direction.

According to a preferred feature of the invention the outermost rib cooperates with the second set of ports to control the delivery of fluid to the second space wherein said outermost rib is located to cooperate with formations in the inner face of the piston chamber to admit fluid from the second set of ports to the second space during the movement of the piston from its impact position to its raised position and one of said annular ribs engage with the second set of ports to at least restrict the flow of fluid to the second space as the piston approaches its fully raised position. According to one preferred embodiment two annular ribs are provided on the other end portion and the one of said annular ribs comprises the innermost set of ribs. According to another embodiment three annular ribs are provided on the other end portion and the intermediate rib comprises the one of said annular ribs. According to a preferred feature of the previous embodiment the one of said annular ribs closes the first set of ports from communication with the third space on the drill bit being axially displaced outwardly from the impact position.

According to a further preferred feature the piston is formed with a central bore which cooperates with a central tubular element extending into the piston chamber from the top sub to be slidably and sealingly engaged therewith during the movement of the piston from its impact position to its raised position wherein the central bore enables fluid to be exhausted from the second space when the central bore is out of engagement with the central tubular element. According to one embodiment the hammer is a reverse circulation hammer and the central tubular element is provided with an axial extension extending into the drill bit, said axial extension not being in sealing engagement with the central bore. According to an alternative embodiment the central tubular element is provided with an outlet at its outer end to enable a restricted flow of fluid into the bore of the piston to be exhausted from the drill bit to be supported by the drill bit support and wherein the drill bit supports a foot valve which is sealingly and slidably engaged by the bore when the piston is at its impact position and for a portion of the movement of the piston from the impact position to the raised position.

The invention will be more fully understood in the light of the following description of three specific embodiments.

BRIEF DESCRIPTION OF THE DRAWINGS

The description is made with reference to the accompanying drawings of which.

DESCRIPTION OF SEVERAL SPECIFIC EMBODIMENTS OF THE INVENTION

Figure 1A:
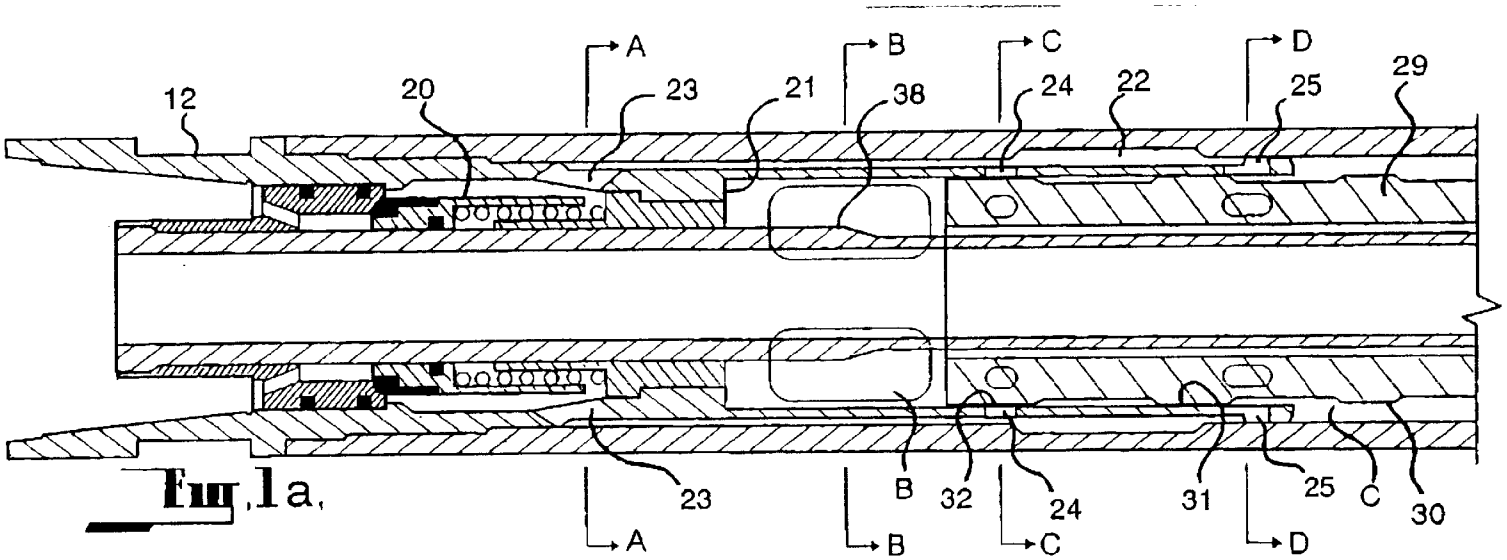
FIG. 1 is a sectional elevation of a hammer according to the first embodiment with the piston in the impact position.

Each of the embodiments relate to hammers which can operate efficiently at high input pressures with an operating cycle rate of the order of 2,000 to 2,500 cycles per minute and with a stroke of the order of 50 to 65 mm.

The first embodiment shown at FIGS. 1, 2, 3, 4, 5, 9 and 11 relates to a downhole hammer comprising a cylindrical casing 11 supporting a top sub 12 at one end and a drill bit support 13 at the other end wherein a piston chamber is provided by the space within the casing between the top-sub 12 and the drill bit support 13. The drill bit support, slidably supports a drill bit 14 which is capable of limited slidable movement within the drill bit support 13 between the two end positions. The drill bit 14 is retained within the drill bit support 13 by a bit retaining ring 15 which is supported in the drill bit support and which engages an annular rib 16 provided on the anvil 17 of the drill bit 14. The drill bit support further comprises a bearing bush 10 which extends into the casing from the bit retaining ring 15.

The hammer of the first embodiment comprises a reverse circulation hammer and is provided with a central tube 18 which extends between the top sub 12 and the drill bit support 13 whereby its outer most end is slidably and sealingly received by the internal wall 19 of the inner bore of the drill bit accommodated by the drill bit support.

Figure 9A:
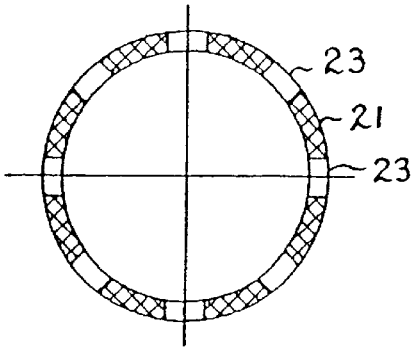
FIG. 9A is a sectional view along line A—A of the sleeve as shown at FIG. 1.

The top sub 12 is provided with a check valve assembly 20 which controls the flow of air into the hammer and supports a sleeve 21 which extends inwardly from the top sub for a portion of the length of the casing and which defines an annular space 22 between the internal wall of the casing 11 and the sleeve 21. As shown at FIG. 9A the end of the sleeve 21 which is received in the top sub is formed with a set of apertures 23 in the region of the check valve 20 to permit the flow of air into the space 22 between the sleeve 21 and the casing 11. The portion of the sleeve 21 contained in the piston chamber is provided with two sets of ports 24 and 25 where the sets of ports 24 and 25 are spaced axially along the sleeve 21.

Figure 1B:
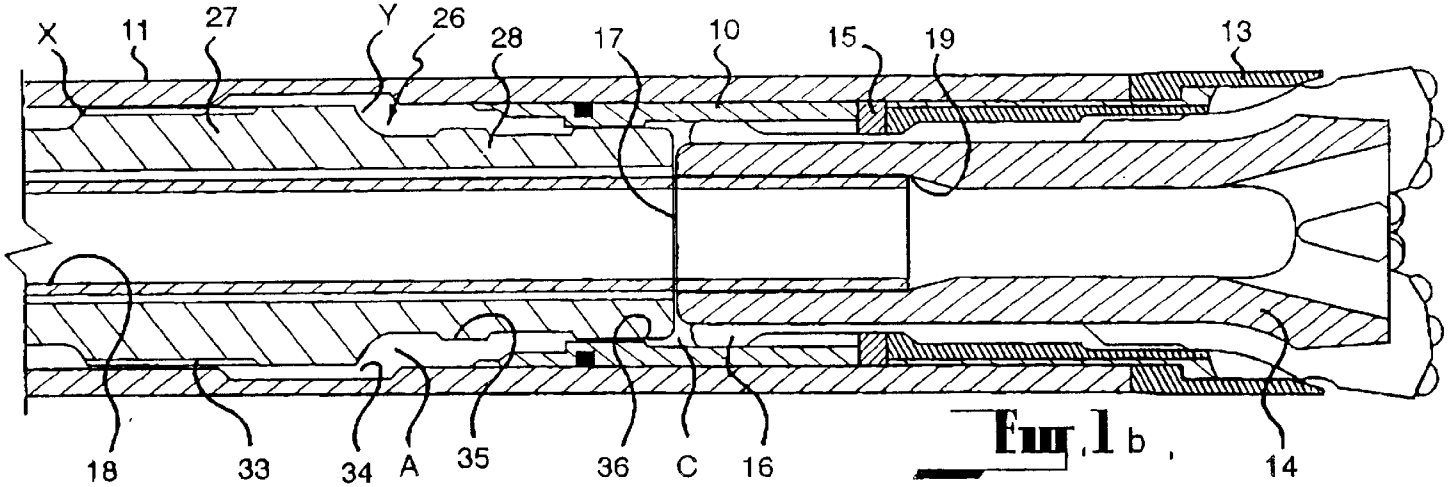
Figure 2A:
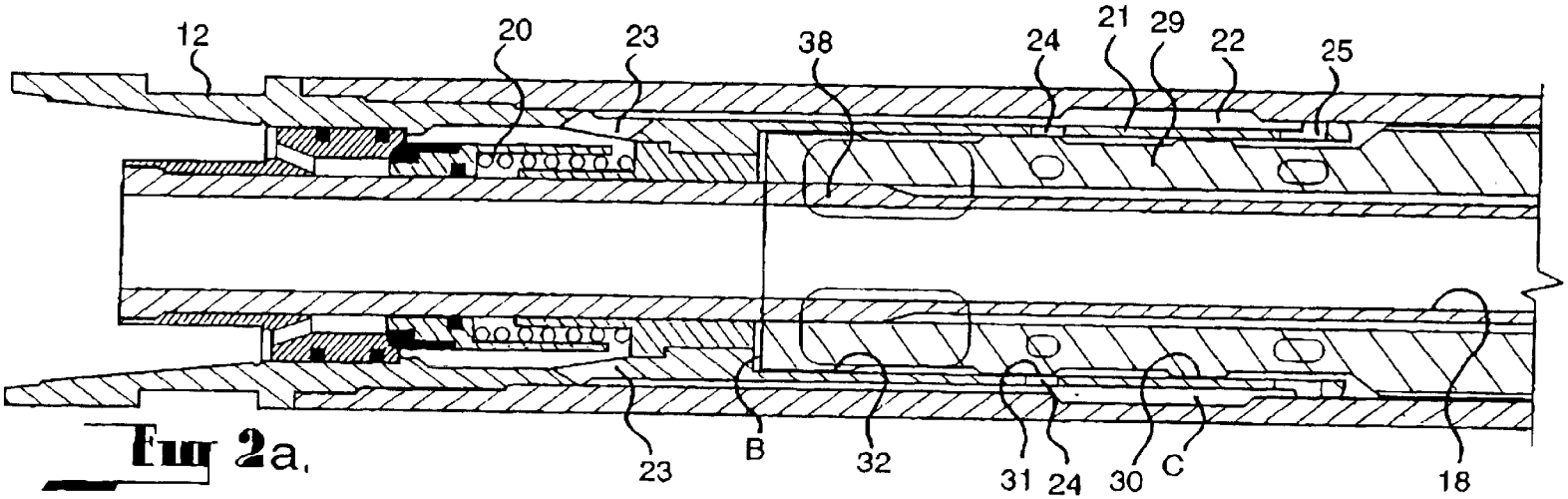
FIG. 2 is a sectional elevation of a hammer according to the first embodiment with the piston in the raised position.
Figure 2B:
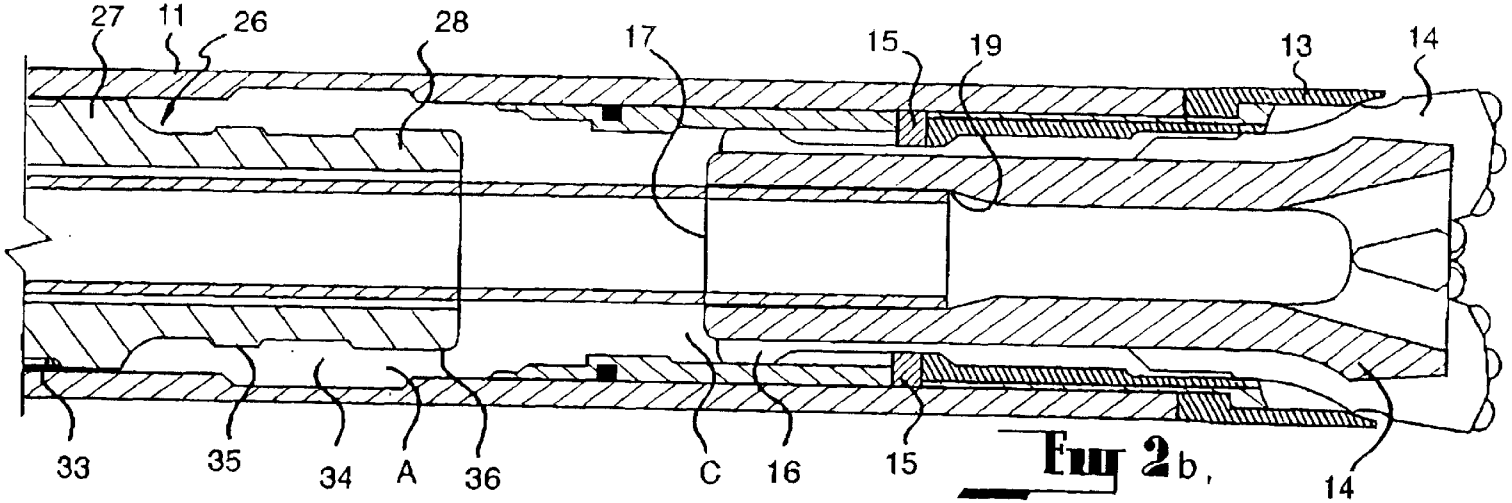

The piston chamber defined by the interior of the casing 11 supports a piston 26 which is slidably received within the casing 11 to be movable between an impact position as shown at FIG. 1 at which its one end is in abutting contact with the anvil 17 of the drill bit 14 when the drill bit 14 is located at its innermost position within the drill bit support 13 and a raised position as shown at FIG. 2 at which the other end is closely adjacent the top sub 12.

The piston 26 is provided with a substantially central portion 27 having a diameter substantially corresponding to the internal diameter of the casing 11 such that it is slidably and sealingly received by the internal wall of the casing for movement between the outermost end of the sleeve 21 and the drill bit support 13. The central portion therefore provides a first shoulder X at its end proximate the top sub and a second shoulder Y at its end proximate the drill bit support wherein the area of the second shoulder is greater than the area of the first shoulder. In addition the central portion 27 of the piston is provided with a set of flute like recesses 33 which extend for a portion of the length of the central portion 27 from the first shoulder X. As shown at FIG. 11 the axes of the flute-like recesses are angularly offset with respect to the central longitudinal axis of the piston such that each recess is offset to the same degree and in the same direction. With reciprocation of the piston in the casing the recesses cyclically cooperate with an annular recessed portion 34 formed in the internal face of the casing 11 at a position adjacent to but spaced axially from the inner end of the bearing bush 10. With the reciprocating slidable movement of the piston within the piston chamber the recesses 33 and the recessed portion 34 cyclically communicate with each other as the piston approaches the impact position.

The reduced diameter of the one end portion 28 of the piston between the central portion 27 and the one end of the piston is provided with a pair of axially spaced annular ribs 35 and 36 which have a diameter such that they will be sealingly engaged with the internal face of the bearing bush 10 when at or in the region of the impact position.

The reduced diameter of the other end portion 29 of the piston between the central portion 27 and the other end of the piston is such that it is sealingly received within the sleeve 21. The sealing portion of the other end portion is defined by a set of three annular ribs 30, 31 and 32 which each have an outer diameter such that they will be slidingly and sealingly engaged with the internal wall of the sleeve 21. The ribs 30, 31 and 32 are spaced axially along the length of the other end portion 29 of the piston 26.

Figure 9B:
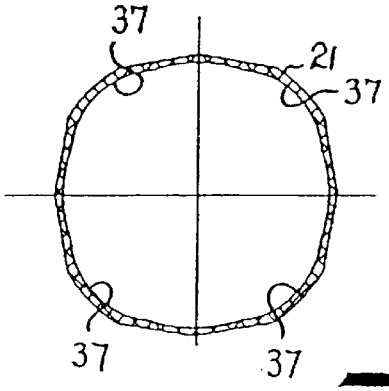
FIG. 9B is a sectional view along line B—B of the sleeve as shown at FIG. 1.
Figure 9C:
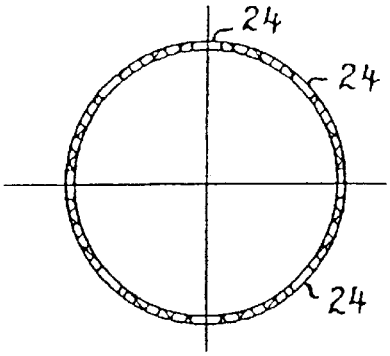
FIG. 9C is a sectional view along line C—C of the sleeve as shown at FIG. 1.
Figure 9D:
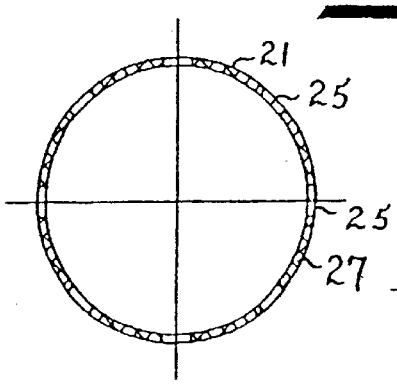
FIG. 9D is a sectional view along line D—D of the sleeve shown at FIG. 1.
Figure 10A:
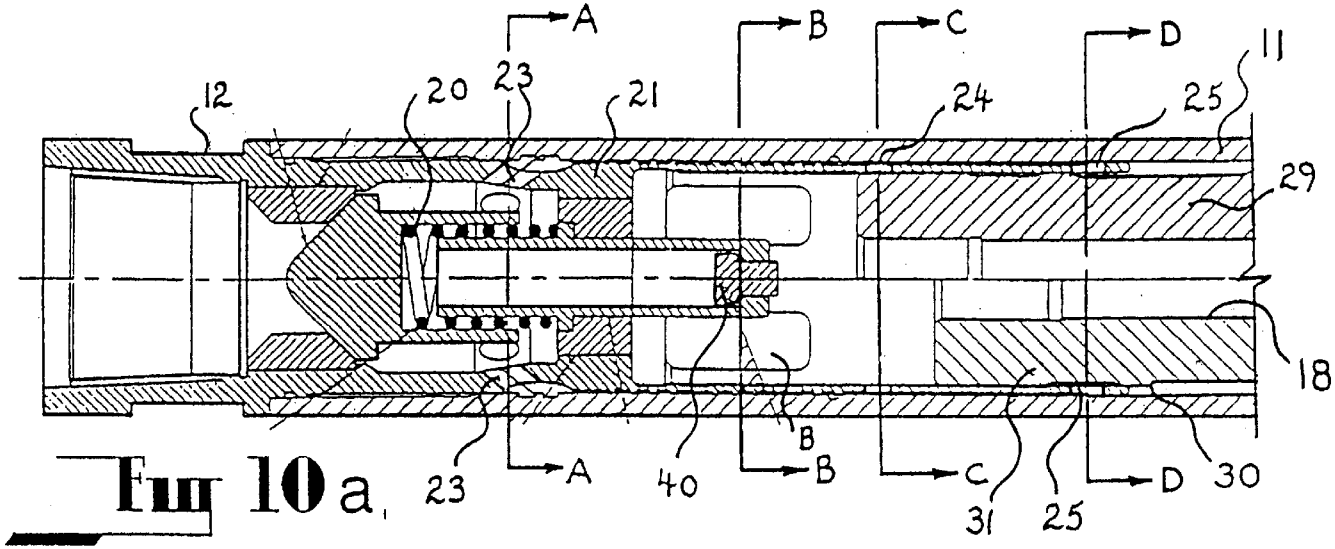
FIG. 10 is a sectional elevation of a hammer according to a third embodiment with the piston in the blow down position.
Figure 10B:
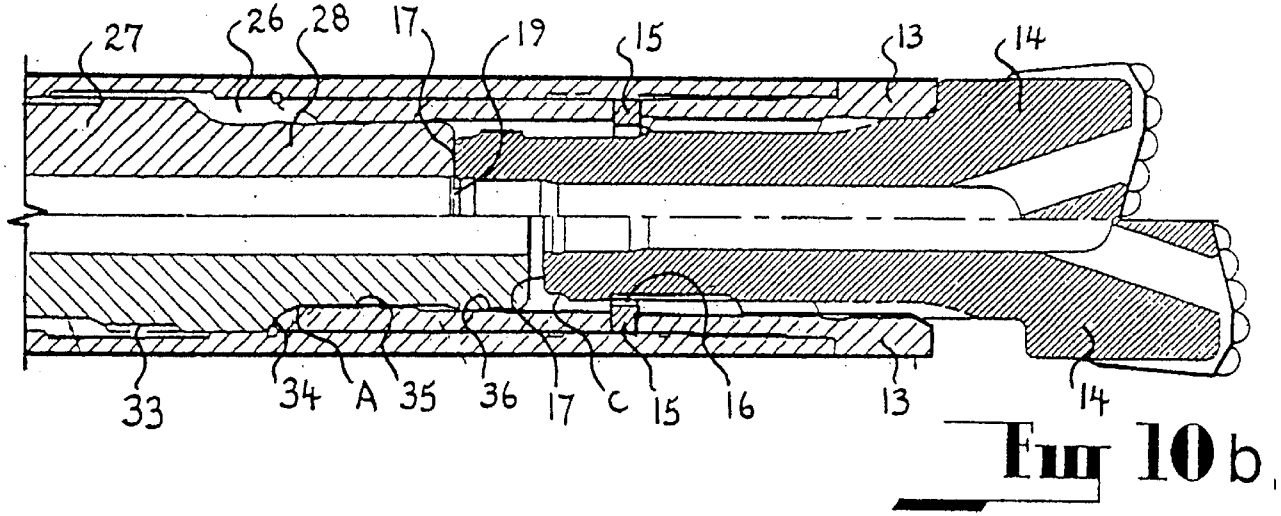
Figure 10C:
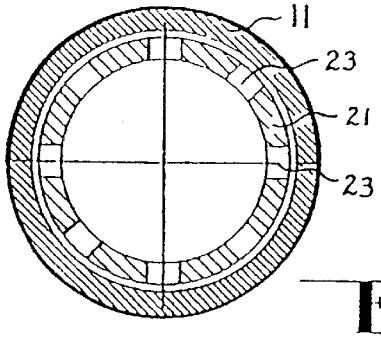
Figure 10D:
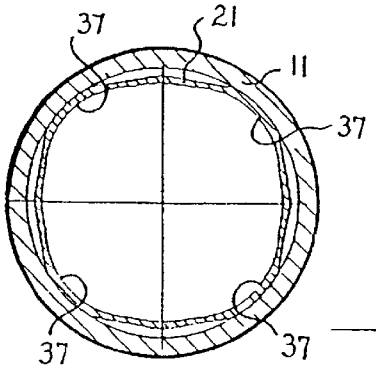
Figure 10E:
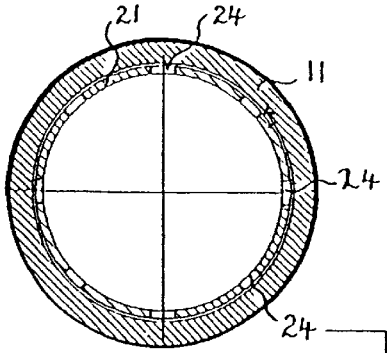
Figure 10F:
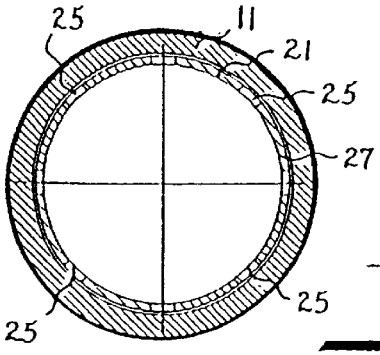
Figure 11A:
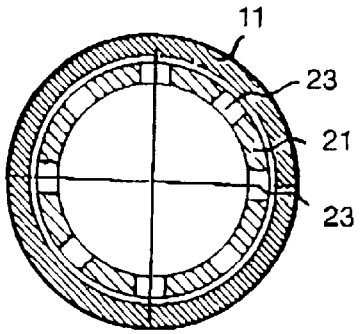
FIG. 11A is a sectional view along line A—A of the sleeve as shown at FIG. 10.
Figure 11B:
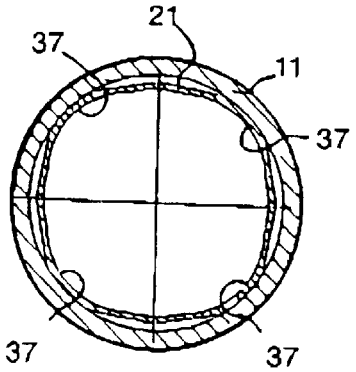
FIG. 11B is a sectional view along line B—B of the sleeve as shown at FIG. 10.
Figure 11C:
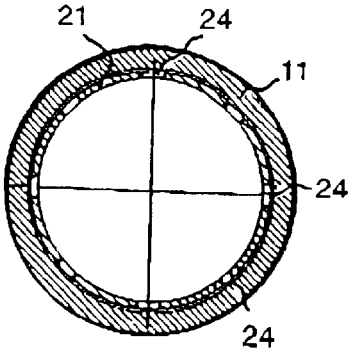
FIG. 11C is a sectional view along line C—C as shown at FIG. 10.
Figure 11D:
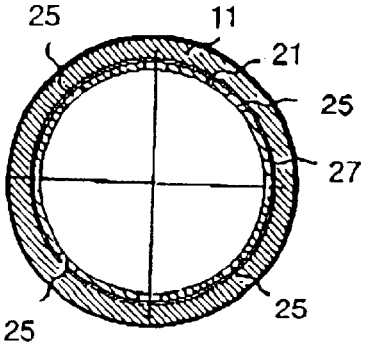
FIG. 11D is a sectional view along line D—D as shown at FIG. 10.
Figure 12:
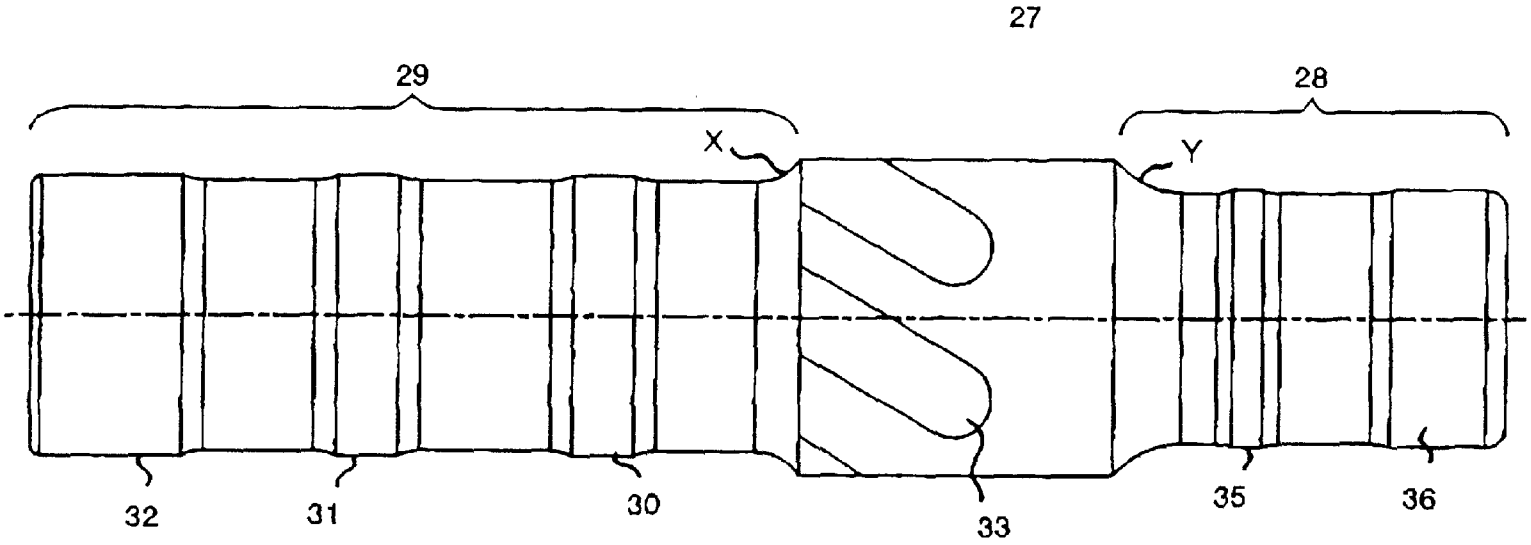
FIG. 12 is a side elevation of the piston according to the first embodiment.

In addition the internal face of the sleeve in the region intermediate the top-sub and the first set of fluid ports 24 is formed with a set of flute-like recesses 37 as shown at FIGS. 1 and 9B.

The portion of the central tube 18 proximate the top sub is formed with an enlarged sealing portion 38 which is of increased diameter to the remainder of the tube such that it will be sealingly engaged with the internal bore of the piston 27 when the piston is in the raised position proximate the top sub and as it approaches and departs from the raised position.

As a result of the result of the configuration of the piston and its cooperation with the casing 11, sleeve 21, drill bit support 13 and the central tube 18, three spaces are formed between the piston and the remaining components of the hammer which serve in effecting the reciprocation of the piston by causing pressurised fluid to be cyclically delivered to those space at each end of the piston to effect reciprocation of the piston and/or the exhausting of fluid from the hammer. The spaces comprise a first space A which is formed between the one end portion 28 of the piston, the opposed walls of the casing 11, the second shoulder Y and the bearing bush 10, a second space B which is formed between the other end of the piston and the top sub, and a third space C which is formed between the radial face of the other end portion 29 of the piston and the internal wall of the casing and the sleeve 21.

Figure 3A:
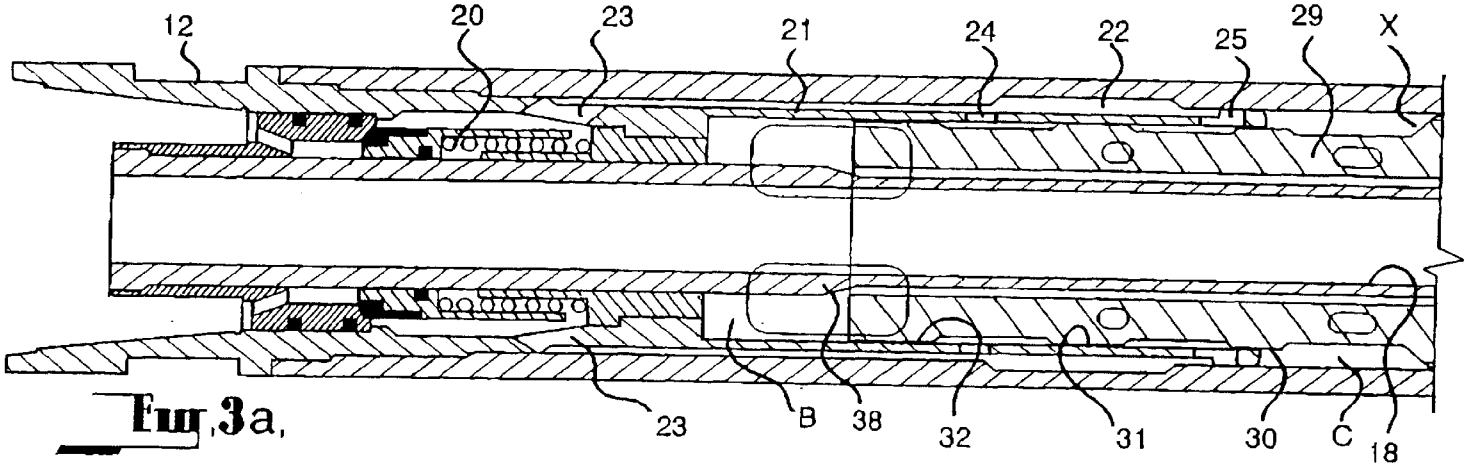
FIG. 3 is a sectional elevation of a hammer according to the first embodiment with the piston at an intermediate position between the raised and impact position.
Figure 3B:
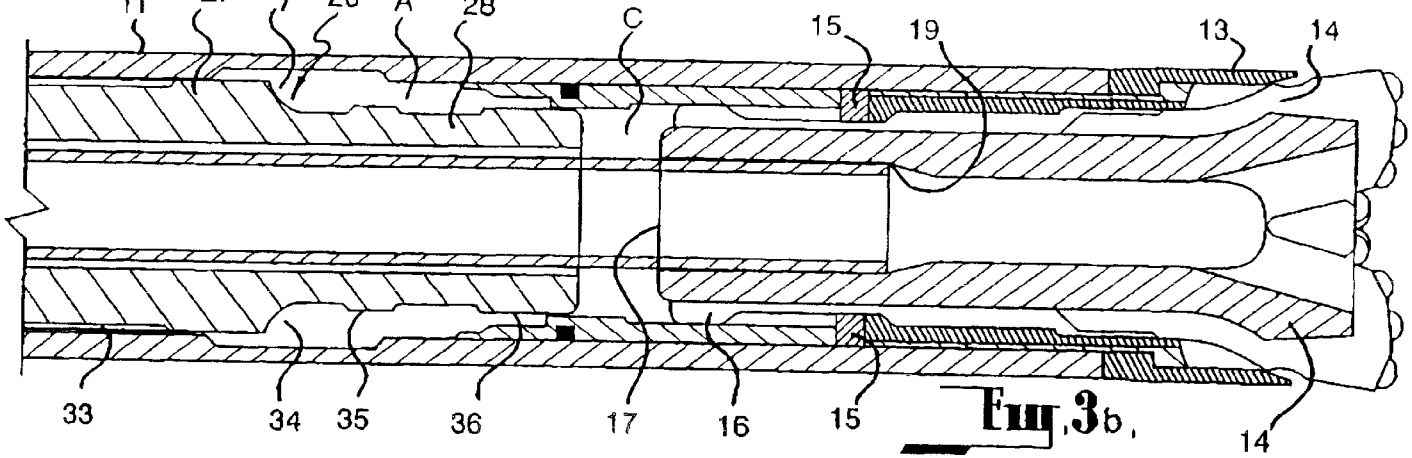
Figure 4A:
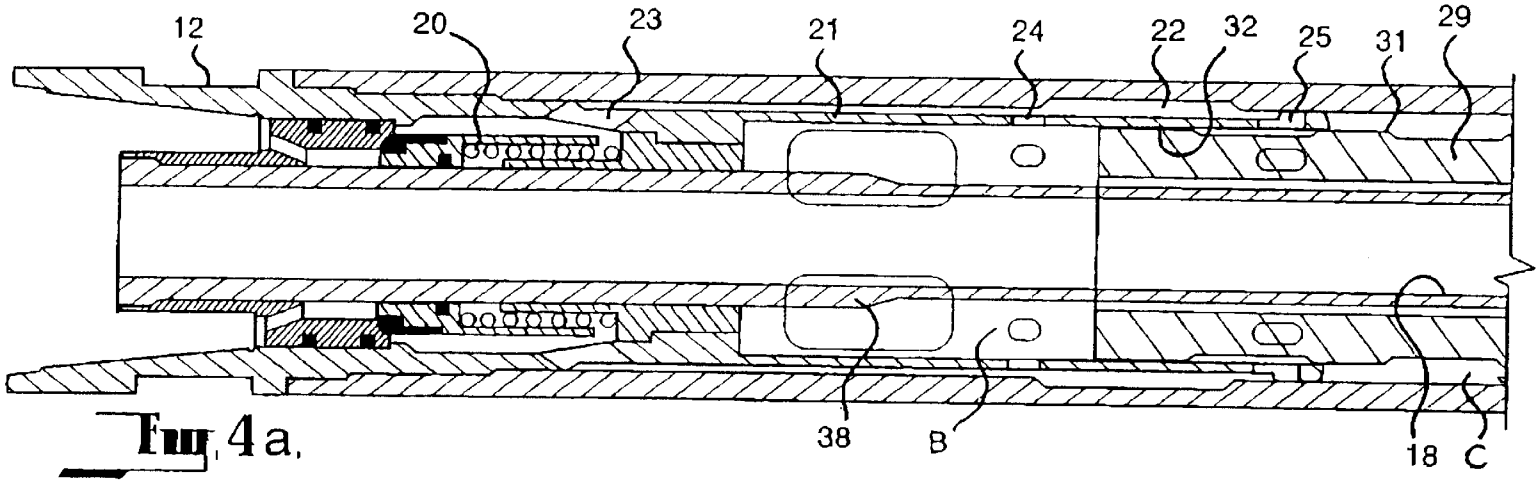
FIG. 4 is a sectional elevation of a hammer according to the first embodiment with the piston in the blow down position.
Figure 4B:
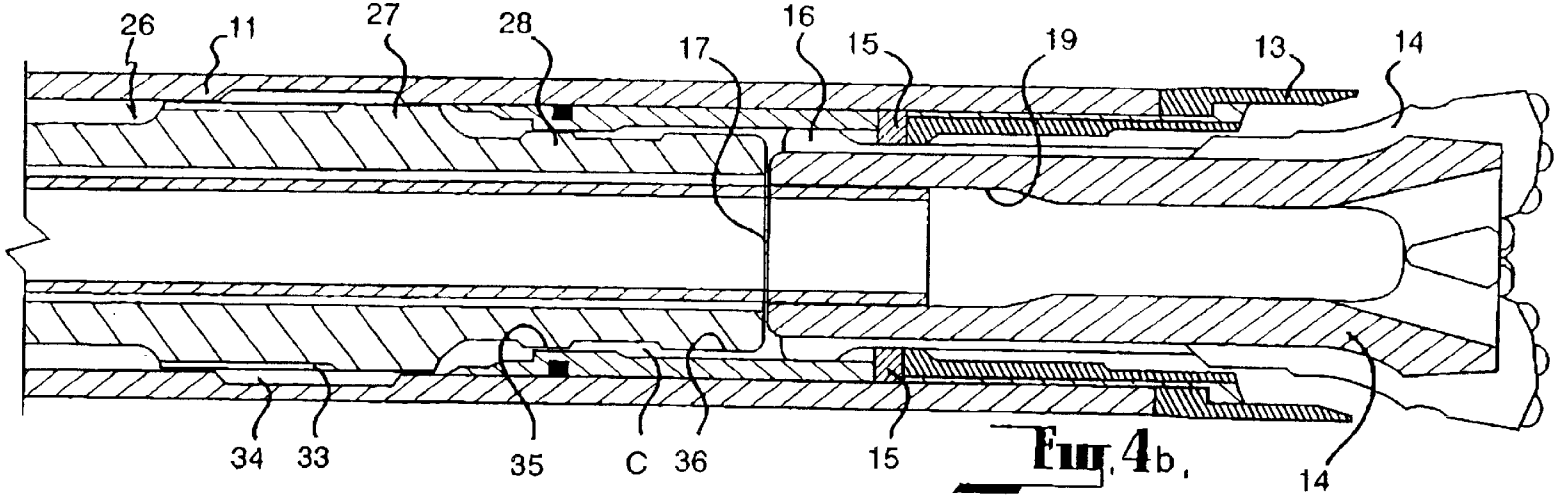
Figure 5A:
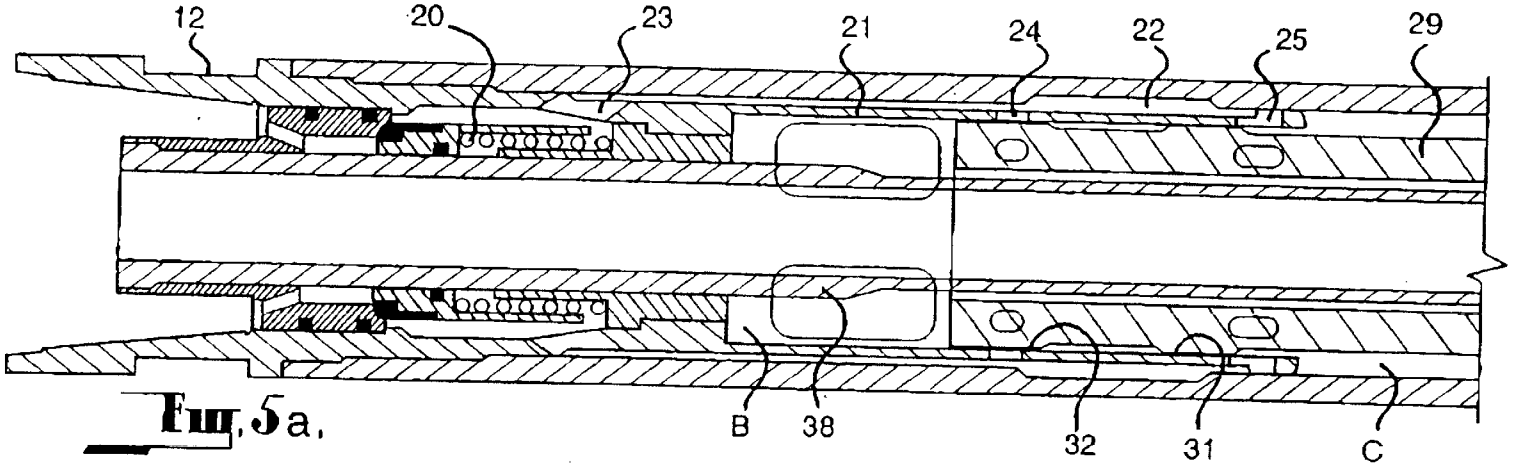
FIG. 5 is a sectional elevation of the second embodiment with the piston in the impact position.
Figure 5B:
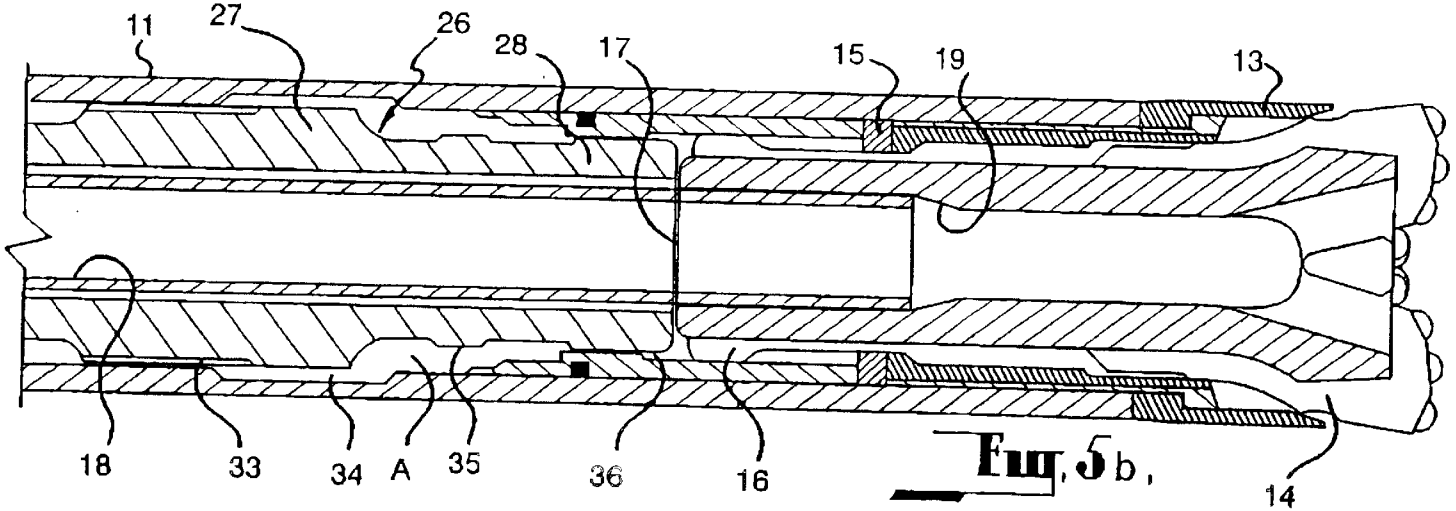

In use when the hammer is in the impact position as shown at FIG. 1 the outermost rib 36 provided on the one end portion 28 is sealingly engaged with the bearing bush 10 to isolate the first space A from the space between the one end of the piston and the anvil 17. When at that position the recesses 33 in the piston communicate with the recessed portion 34 in the wall of the casing and as a result, the first space A is in communication with the third space C through the recesses 33 and recessed portion 34 in the interior wall of the casing. In addition the outermost and intermediate ribs 32 and 31 respectively of the other end portion 29 of the piston are sealingly engaged with the internal face of the sleeve 21 while the innermost rib 30 is spaced axially outwardly from the sleeve 21. This results in the first set of fluid ports 24 being sealingly closed by the outermost rib 32 but the second set of ports 25 being in open communication with the third space C. As a result pressurised fluid is introduced into the third space C and thus into the first space A as a result of the communication therebetween through the recesses 33 and the recessed portion 34 and there is a differential of forces applied between the first and second shoulders X and Y as a result of such fluid pressure in favour of the second shoulder the resultant effect of which is that the piston is driven from the impact position shown at FIG. 1 towards the raised position shown at FIG. 2 and in so doing through the intermediate position as shown at FIG. 3. In addition when the piston is at the impact position and approaching or departing from the impact position the second spaced B is in communication with the exhaust in the drill bit support through the annular space provided between the central tube 18 and the internal bore of the piston. Therefore as the piston moves towards the raised position of FIG. 2 any pressurised fluid within the second space B is displaced through the bore of the piston to the third space C from which it is vented into the bore hole through the drill bit support 13.

When the piston is at an intermediate position (see FIG. 3), the recesses 33 provided on the central portion of the piston disengage from the recessed portion 34 of the casing to prevent any further admission of fluid into the first space A and the innermost rib 30 on the other end portion 29 of the piston becomes sealingly engaged with the sleeve 21 to isolate the second set of fluid ports 25 from the third space C such that no further fluid is admitted into the third space C at that time. In addition, as shown at FIG. 3, the outermost rib 32 of the other end portion 29 becomes disengaged from the first set of ports 24.

With further movement of the piston towards the raised position, the outermost rib 36 on the one end portion 28 of the piston becomes disengaged from the drill bit support such that the first space A will vent to the exterior of the hammer through the exhaust in the drill bit support. In addition at this position, the bore of the piston sealingly engages the sealing portion 38 of the central tube 18 to sealingly isolate the second space B while the outermost rib 32 on the other end portion is received in the portion of the sleeve having the internal flutes 37. As a result the first set of fluid ports 24 open into communication with the second space B, through the flute-like recesses 37 formed on the inner face of the sleeve to cause pressurised fluid to be admitted into the second space B. This fluid serves to apply pressure to the other face of the piston which with the pressure in the third space C which is applied to the first shoulder X of the central portion of the piston serves to decelerate the piston as it approaches the raised position. However before the piston reaches its fully raised position the intermediate rib 31 moves into engagement with the first set of ports 24 to restrict and finally close the first set of ports. This restriction of the delivery of fluid to the second space B enables the momentum of the piston to be used to carry it to the fully raised position. When at the fully raised position the fluid pressure exerted by the compressed fluid entrapped in the second space B and the third space C exerts a force on the piston to drive it towards the impact position and in so doing passes through the intermediate position shown at FIG. 3. As the piston moves from the fully raised position a fresh injection of fluid is made into the second space B and the third space C as the first and second set of ports are be opened by such movement. Such injection serves to supplement the energy initially supplied to the piston by the entrapped compressed fluid contained in the second and third spaces B and C respectively.

As a result of the arrangement of the hammer of the first embodiment, fluid pressure is sequentially applied to the piston to effect its movement to the impact position and the fluid pressure is supplied intermittently at the appropriate time rather than being applied constantly. In particular air is supplied intermittently to the third space C whereby when the piston is at its impact position fluid is admitted to the first space though the third space C in order that the piston is able to effect its upstroke to the raised position. Subsequently when the piston is approaching its raised position fluid is introduced into the third space C and the second space B at the upper reaches of the upstroke at which time it is desired that the piston be decelerated. However the delivery of fluid to the second space is at least restricted towards the end of the movement of the piston to the raised position to allow the piston to maximise its stroke.

It is a further characteristic of the embodiment that when the piston is in the impact position the intermediate rib 31 of the other end portion 29 of the piston is located closely adjacent the second set of fluid ports 25 which deliver air into the first space A via the third space C. In circumstances where the hammer is being used in soft ground it is not unusual for the drill bit to be caused to be displaced outwardly with respect to the drill bit support which results in inefficient drilling and a condition which is a wasteful of pressurised fluid. The embodiment serves to avoid this practice, in that if the drill bit 14 is caused to be displaced outwardly with respect to the drill bit support 13 the intermediate rib 31 provided on the other end portion 29 will move into engagement with the second set of fluid ports 25 to restrict, if not, shut off the flow of air to the third space C and thus the first space A which will cause the hammer to shut down.

When it is required to deactivate the hammer, the hammer is lifted from the bottom of the bore hole such that the drill bit will move outwardly within the drill bit support 13 such that the annular rib 16 provided on the anvil 17 is supported by the drill bit retaining ring 15 (ie the blow down position). As a result of such on the piston's next downward stroke it will move into further engagement with the drill string such that the innermost rib 31 formed on the one end portion 28 of the piston is sealingly engaged in the drill bit support to isolate the first space A from the third space C and to cause the first set of fluid ports 24 to communicate freely with the second space B such that the pressurised fluid initially applied to the other end of the piston is vented through the bore of the piston to the exhaust in the drill bit support.

Figure 6A:
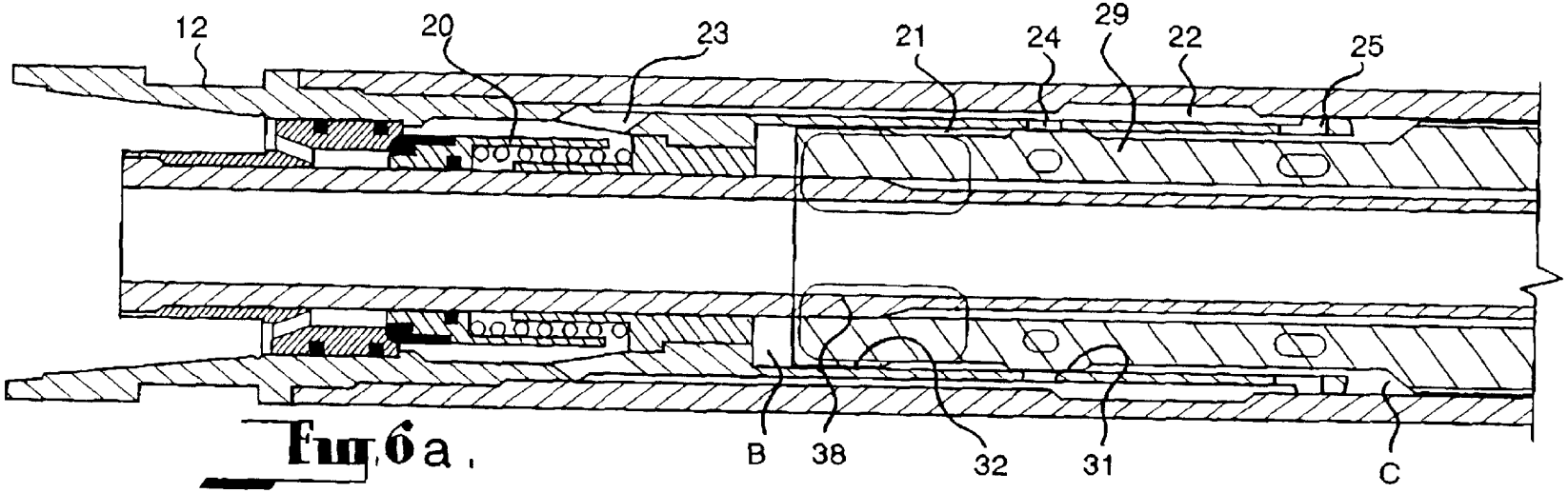
FIG. 6 is a sectional elevation of a hammer according to the second embodiment with the piston in the raised position.
Figure 6B:
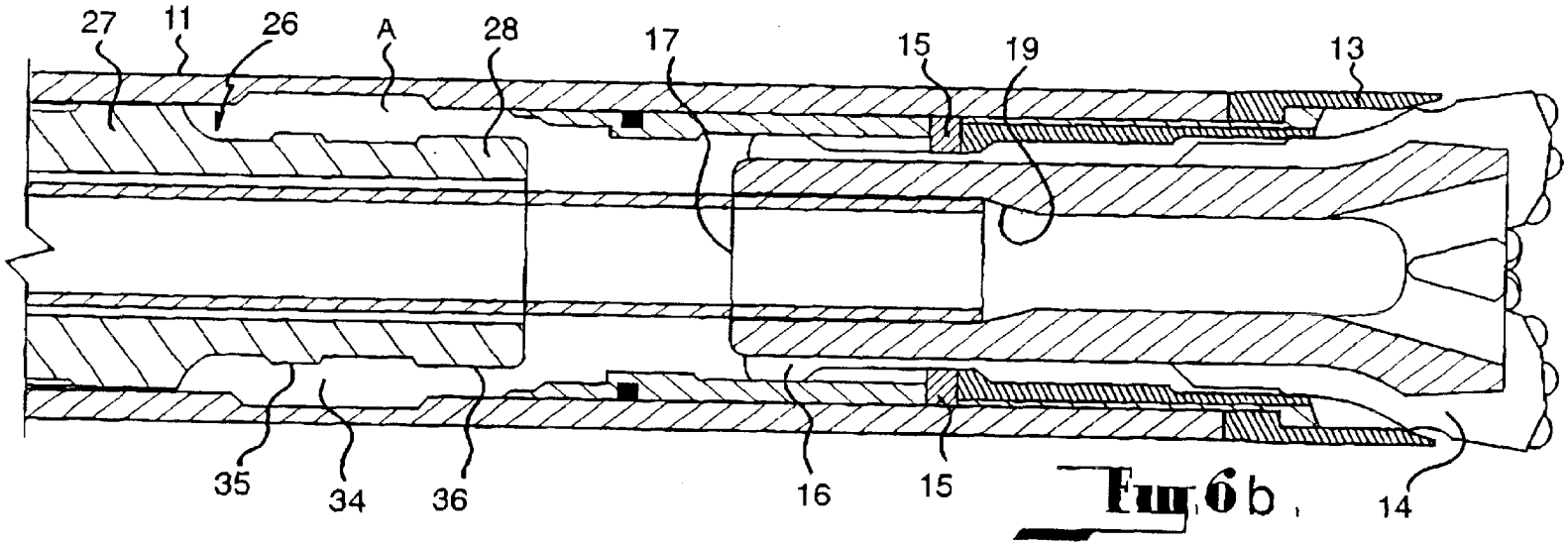
Figure 7A:
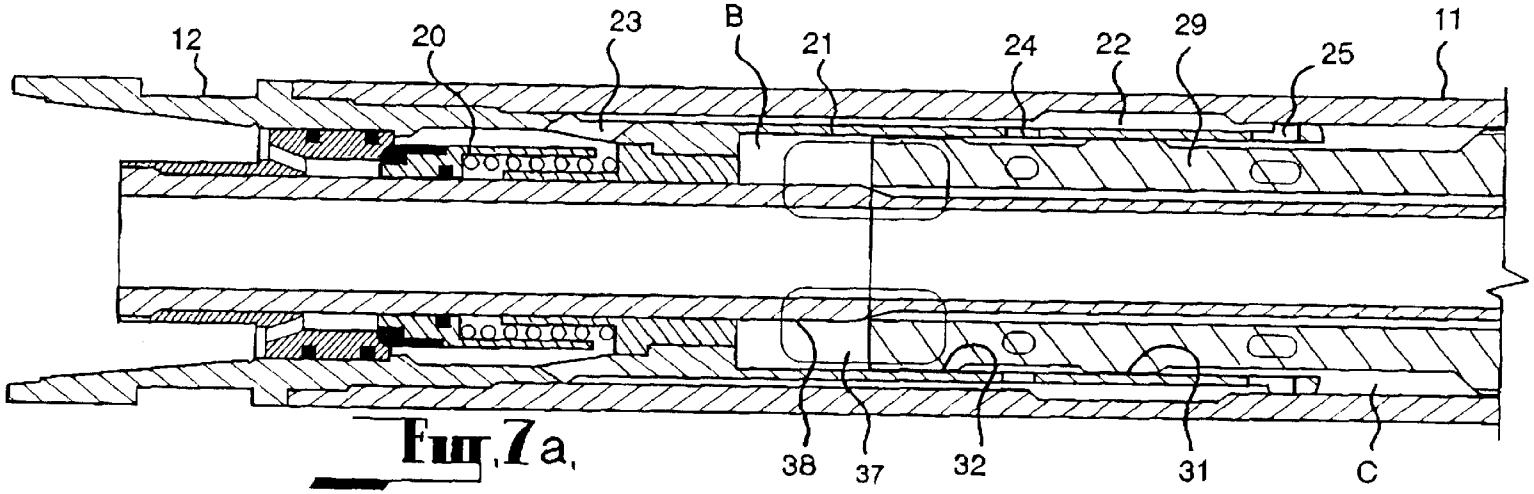
FIG. 7 is a sectional elevation of a hammer according to the second embodiment with the piston in an intermediate position.
Figure 7B:
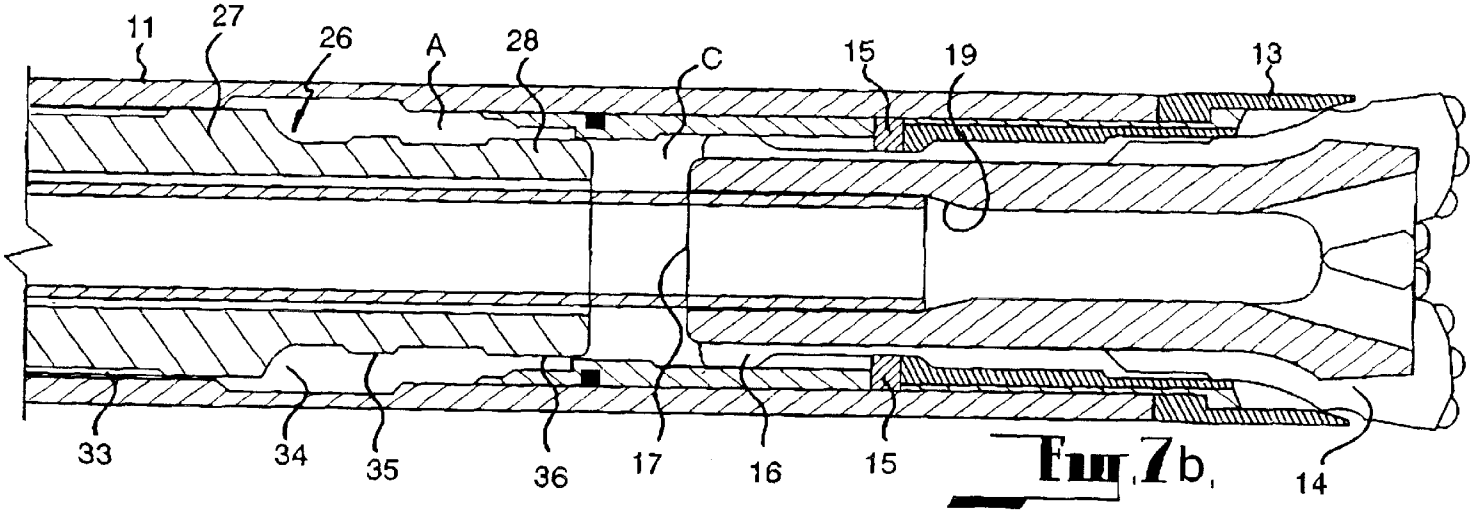
Figure 8A:
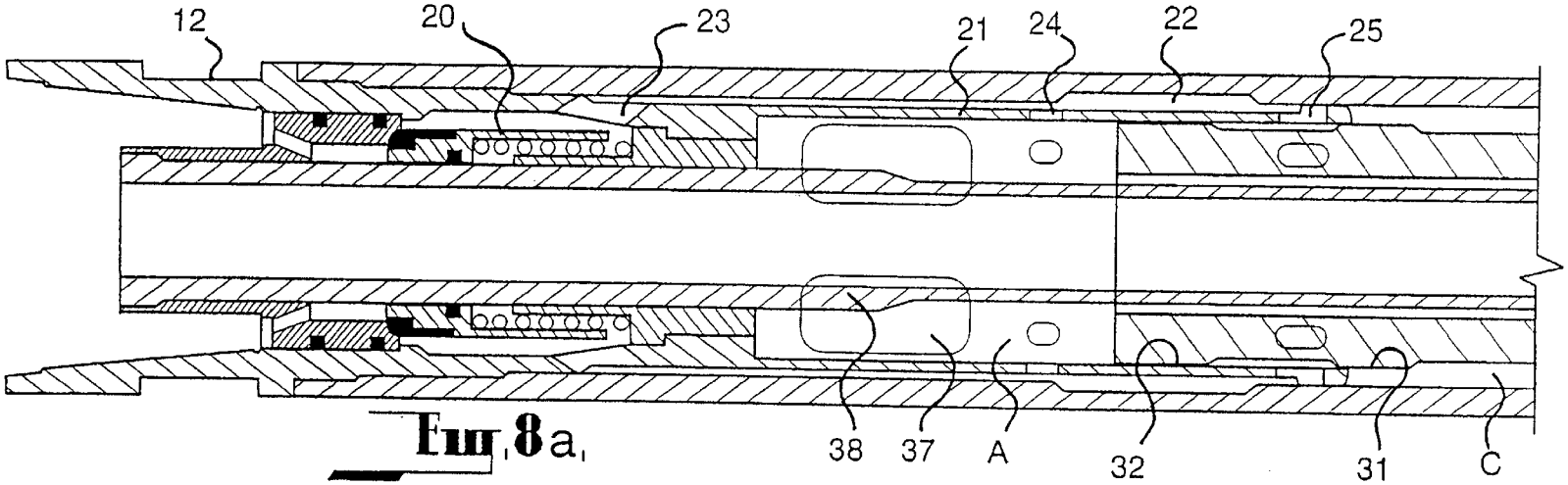
FIG. 8 is a sectional elevation of a hammer according to the second embodiment with the piston in the blow down position.
Figure 8B:
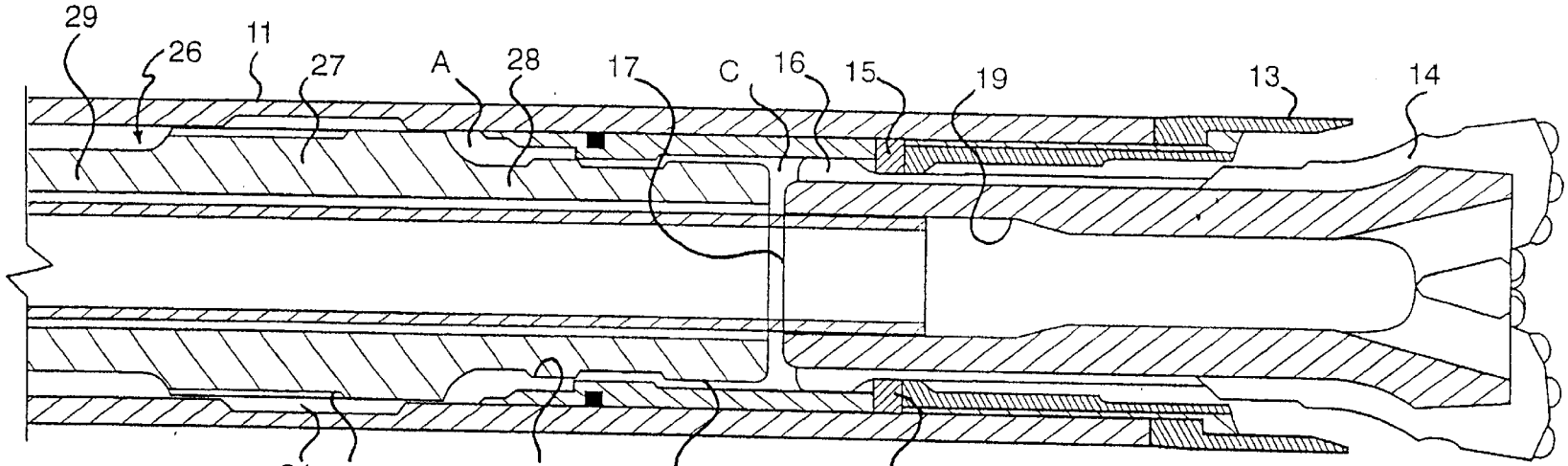

The second embodiment as shown at FIGS. 5, 6, 7 and 8 is of a corresponding form to that of the first embodiment and therefore the same reference numerals have been used and the description of the first embodiment is equally applicable to the second embodiment, with the exception of the number of ribs provided on the other end portion 29 of the piston. In the case of the second embodiment the other portion of the piston is provided with only two sets of ribs being the outermost and intermediate ribs 32 and 31 respectively of the first embodiment. As a result the second set of fluid ports 25 are not isolated from communication with the third space C during the reciprocation of the hammer. In addition as the piston approaches the fully raised position as shown at FIG. 6 the innermost rib 31 on the other end portion of the piston closes off the first set of ports to restrict the delivery of pressurised fluid to the second space B. It is envisaged that the second embodiment can be utilised with lower fluid pressures.

The third embodiment as shown at FIGS. 10, 10A, 10B, 10C and 10D is of a corresponding form to that of the first embodiment with the exception that the hammer is a conventional hammer and therefore the same reference numerals have been used and the description of the first embodiment is equally applicable to the third embodiment. The difference in relation to the third embodiment relates to the central tube 18 which terminates within the piston chamber. The central tube 18 may be closed or if the ground conditions require can accommodate a choke 40 which delivers a controlled amount of fluid into the bore of the piston to be exhausted into the borehole through the drill bit support whereby the fluid exhausted from the choke and the piston chamber as a result of the action of the hammer carry the cuttings generated by the drill bit 14 to the surface between the drill string and the bore hole.

According to a variation of each of the, embodiments the junction between the inner end of the sleeve 21 and the internal wall of the casing is provided with one or more apertures which provide a constant delivery of pressurised fluid into the third space C. If desired the openings may be restricted to limit the flow into the third space C. In addition if desired the openings may replace the first set of ports 25 pressurised fluid delivered to the hammer is caused to pass through the spaces provided between the walls of the piston chamber and the piston and as a result the lubricant which is carried with the fluid is carried directly to the opposed surfaces of the piston and the piston chamber requiring lubrication. In the instances of some prior art hammers (eg AU-B-40793/96) The fluid with its entrained lubricant is delivered into locations in the hammer where the action of the lubricant is not as critical and the distribution of the lubricant to the critical surfaces is indirect.

It is a feature of each of the embodiments that the flute-like recesses 33 in the piston which enable the pressurised fluid to enter the first space are angularly offset. This results in a force being applied to piston which will cause it to slowly rotate within the casing which, it is believed will facilitate the lubrication of the adjacent surfaces between the piston and the casing and result in a substantially uniform wear on the piston, the sleeve, the bearing bush, the central tube and the casing.

It is further feature of the embodiments that to effect the movement of the piston to the impact position pressurised fluid is introduced to pressure surfaces being the other end of the piston and the first shoulder. In addition the injection of fresh pressurised fluid is applied intermittently and sequentially once the piston has commenced its downstroke such that the fresh injection supplements the energy which has already been applied to the piston. Furthermore this manner of injection ensures that the use of the pressurised fluid is more efficient since the introduction of pressurised fluid into the second space is restricted when the piston approaches its fully raised position at which point in time decelerates, changes direction and accelerates.

It is a further feature of the embodiments that the mass of the piston can be maximised since all of the valving for the hammer is provided by formations such as flutes and recesses in the piston and casing rather than by providing counterbores and ports in the body of the piston.

Throughout this specification (including the claims if present), unless the context requires otherwise, the word "comprise", or variations such as "comprises" or "comprising", will be understood to imply the inclusion of a stated integer or group of integers but not the exclusion of any other integer or group of integers.

It should be appreciated that the scope of the present invention need not be limited to the particular scope of the embodiments described above and in particular although the first and second embodiments are directed to reverse circulation hammers the invention need not be so restricted and may be directed to a conventional form of down the hole hammer in which fluid and cuttings are returned to the surface between the drill string and the bore hole.

The claims defining the invention are as follows:

1. A down hole hammer comprising a cylindrical casing having a top sub at one end which is adapted to be mounted to a drill string and a drill bit support at the other end to define a piston chamber, said drill bit support being adapted to receive a drill bit, a piston received within the piston chamber for reciprocation between the one end and the other end, said piston being formed with a central portion which is slidingly and sealingly engaged with the internal wall of the casing, said central portion providing a first shoulder at the end proximate the top sub, said piston having one end portion which is intended to impact on the drill bit on movement of the piston to an impact position and the one end portion being configured to be sealingly engaged with the drill bit support and/or the internal face of the piston chamber when the piston is in the impact position to define a first space between the internal wall of the piston chamber, the one end portion and the drill bit support, a portion of the length of the internal wall of the casing adjacent the top sub being provided with two sets of fluid delivery ports at locations spaced axially along the portion of the length of the casing, the external radial face of the piston and or the radial face of the piston chamber being formed to enable the piston to cooperate with the internal wall of the casing and with a first set of said fluid ports to admit fluid into the first space when the piston is in the impact position to cause movement of the piston to a raised position at which position the piston is in spaced relation from the drill bit support, the external radial face of the piston and or the radial face of the piston chamber being formed to enable the piston to cooperate with the internal wall of the casing and with the second set of said set of ports to admit fluid into a second space between the piston and the top sub when the piston is adjacent the top sub to cause movement of the piston to the impact position, wherein the admission of fluid to the second space is at least reduced as the piston moves to a fully raised position.

2. A down hole hammer as claimed at claim 1 wherein the drill bit support further comprises, in part, an annular bush supported in the casing to extend into the piston chamber from the drill bit support, the one end portion of said piston having a reduced diameter to provide a second shoulder at the proximate end of the central portion, the area of the second shoulder being greater than the area of the first shoulder, the one end portion being configured to be sealingly engaged with the annular bush when the piston is in the impact position to define the first space.

3. A down hole hammer as claimed at claim 1 wherein the portion of the length of the internal wall of the casing is defined by an inner sleeve extending from the top sub in the direction of the drill bit support and providing a plenum space between the sleeve and the casing which is in communication with fluid being delivered from the top sub, said sets of fluid ports being provided in the sleeve.

4. A down hole hammer as claimed at claim 3 wherein the inner sleeve provides a portion of the internal face of the piston chamber which is of reduced diameter.

5. A down hole hammer as claimed at claim 3 wherein the other end portion of the piston is of a reduced diameter and is formed with at least two annular ribs at axially spaced locations along the other end portion which are slidably and sealingly engaged with the inner sleeve wherein a third space is defined between the radial face of the piston chamber, the radial face of the piston, the innermost rib and the first shoulder.

6. A down hole hammer as claimed at claim 5 wherein the third space is able to open into the first space when the piston is at or in the vicinity of the impact position.

7. A down hole hammer as claimed at claim 6 wherein the external radial face of the piston and the internal radial face of the piston chamber are formed to provide cooperating formations which control the flow of fluid between the third and first space with relative movement between the piston and the piston chamber.

8. A down hole hammer as claimed at claim 7 wherein the cooperating formations in the surface of the piston and the piston chamber comprise a plurality of flute-like recesses formed on the surface of the central portion which extend from the first shoulder to an intermediate location on the central portion and one or more recesses formed in the internal face of the casing.

9. A down hole hammer as claimed at claim 8 wherein the flute-like recesses are angularly offset from the longitudinal axis of the piston to substantially the same extent and in substantially the same direction.

10. A down hole hammer as claimed at claim 5 wherein the innermost rib is located to cooperate with the first set of ports to control the delivery of fluid to the third space wherein fluid flow to the third space is closed as the piston approaches the raised position.

11. A down hole hammer as claimed at claim 5 wherein the first set of ports are in constant communication with the third space.

12. A down hole hammer as claimed at claim 5 wherein the axially outermost rib cooperates with the second set of ports to control the delivery of fluid to the second space wherein said outermost rib is located to cooperate with the inner face of the piston chamber to admit fluid from the second set of ports to the second space during the movement of the piston from its impact position to its raised position and one of said annular ribs engage with the second set of ports to at least restrict the flow of fluid to the second space as the piston approaches its fully raised position.

13. A down hole hammer as claimed at claim 12 wherein two annular ribs are provided on the other end portion and the one of said annular ribs comprises the axially innermost set of ribs.

14. A down hole hammer as claimed at claim 12 wherein three annular ribs are provided on the other end portion and the intermediate rib comprises the one of said annular ribs.

15. A down hole hammer as claimed at claim 12 wherein the one of said annular ribs closes the first set of ports from communication with the third space on the drill bit being axially displaced outwardly from the impact position.

16. A down hole hammer as claimed at claim 1 wherein the piston is formed with a central bore which cooperates with a central tubular element extending into the piston chamber from the top sub to be slidably and sealingly engaged therewith during the movement of the piston from its impact position to its raised position wherein the central bore enables fluid to be exhausted from the second space when the central bore is out of engagement with the central tubular element.

17. A down hole hammer as claimed at claim 16 wherein the hammer is a reverse circulation hammer and the central tubular element is provided with an axial extension extending into the drill bit, said axial extension not being in sealing engagement with the central bore.

18. A down hole hammer as claimed at claim 16 wherein the central tubular element is provided with an outlet at its outer end to enable a restricted flow of fluid into the bore of the piston to be exhausted from the drill bit to be supported by the drill bit support and wherein the drill bit supports a foot valve which is sealingly and slidably engaged by the bore when the piston is at its impact position and for a portion of the movement of the piston from the impact position to the raised position.

* * * * *